United States Patent [19]

Sabins

[11] 4,089,767

[45] May 16, 1978

[54] ANODE SYSTEM FOR THE CATHODIC PROTECTION OF OFF SHORE STRUCTURES

[75] Inventor: Rolland C. Sabins, Lakeside, Calif.

[73] Assignee: Sabins Industries, Inc., Long Beach, Calif.

[21] Appl. No.: 742,674

[22] Filed: Nov. 17, 1976

Related U.S. Application Data

[63] Continuation-in-part of Ser. No. 707,675, Jul. 22, 1976, and Ser. No. 719,990, Sep. 2, 1976, which is a continuation-in-part of Ser. No. 707,675, , and Ser. No. 512,108, Oct. 4, 1974, abandoned.

[51] Int. Cl.[2] ..... C23F 13/00

[52] U.S. Cl. ..... 204/197; 114/222; 114/270

[58] Field of Search ..... 114/222, 270; 204/147, 204/148, 196, 197

[56] References Cited

U.S. PATENT DOCUMENTS

| | | | |
|---|---|---|---|
| 285,615 | 9/1883 | Hannay | 204/197 |
| 2,838,453 | 6/1958 | Randall | 204/197 |
| 2,870,079 | 1/1959 | McCall | 204/197 |
| 3,004,905 | 10/1961 | Sabins | 204/147 |
| 3,104,220 | 9/1963 | Preiser | 204/196 |
| 3,425,925 | 2/1969 | Fleischman | 204/197 X |
| 3,635,813 | 1/1972 | Drisko et al. | 204/197 |
| 3,660,264 | 5/1972 | Schuller | 204/197 |

*Primary Examiner*—Trygve M. Blix
*Assistant Examiner*—Sherman D. Basinger
*Attorney, Agent, or Firm*—Trask & Britt

[57] ABSTRACT

A cathodic protection system for metallic structures disposed in contact with marine brine includes a plurality of sacrificial marine anodes mechanically linked in a chain suspended above the brine with a portion of the chain immersed in the brine. The chain of anodes is electrically coupled to the structure, and means are provided for selectively releasing and retrieving the chain from storage to correspondingly increase or decrease the length of chain immersed in the brine.

23 Claims, 5 Drawing Figures

ANODE SYSTEM FOR THE CATHODIC PROTECTION OF OFF SHORE STRUCTURES

RELATED APPLICATIONS

This application is a continuation-in-part of U.S. patent application Ser. No. 707,675, filed July 22, 1976 which discloses and claims aluminum marine anodes with core activators. This application is also a continuation-in-part of U.S. application Ser. No. 719,990, filed Sept. 2, 1976 (which application itself is a continuation-in-part of the aforesaid Ser. No. 707,675 and U.S. application Ser. No. 512,108, filed Oct. 4, 1974, now abandoned) disclosing and claiming zinc anodes with activators. The parent applications all describe special anodes of various types wherein a sacrificial marine anode is provided with a second metal or other activator material which exhibits a surface potential less negative than about −300 millivolts with respect to a silver-silver chloride half cell. The system described and claimed by the present application may utilize anodes with activating cores similar to those described and claimed by the parent applications.

BACKGROUND OF THE INVENTION

Field

This invention pertains to the cathodic protection of metallic structures such as drilling rigs, sea walls and the like disposed in contact with marine environments. It is specifically directed to systems including sacrificial anodes disposed within the marine environment and electrically coupled to the structure being protected. It provides a new assembly of components whereby the surface area of sacrificial anode material exposed to the sea water environment may be adjusted as needed to control the current density of the circuit between the anode material and the structure.

State of the Art

The cathodic protection of off-shore platforms and drilling ships, bridges and other structures exposed to marine environments is an art which has been practiced for many years. The objective of all such systems is to adjust current flow from anodes to the structure thereby to elevate the polarization level of the structure within the "protected" range; that is, the level at which electron emission from the protected structure to the marine brine is substantially inhibited, thereby suppressing corrosion of the structure.

Among the systems employed in the past have been the so-called "impressed current" systems whereby a power supply is used to impress a potential difference between the structure and an anode suspended in the sea water environment. These systems are sometimes automated to adjust the current flow by adjusting the driving voltage through a power supply connected to the anodes. Other systems have involved magnesium anodes coupled to the structure and including an adjustable resistance between the anode and ground to control the current flow through the circuit. These resistances result in a very low coulomb efficiency. Moreover, none of the prior art systems are adequately responsive to changing environmental conditions. Further, the maintenance and installation costs of the prior art systems have been unacceptably high.

SUMMARY OF THE INVENTION

According to the present invention, metallic structures disposed in contact with marine environments, such as ocean brines, are protected by a system whereby the surface area of a sacrificial marine anode composition in circuit with the structure to be protected is mechanically adjusted from time to time to maintain the appropriate polarization level on a structure. The system is best embodied as a plurality of sacrificial marine anodes mechanically linked in a chain. The individual anodes are also conductively connected in a chain, and the chain is conductively connected to the structure. Means are provided in association with the structure to suspend the chain above the brine with a portion of the chain immersed in the brine. Further means are provided for selectively releasing and taking up the chain to correspondingly increase or decrease the surface area of the chain immersed in the brine. By increasing the amount of chain immersed, the current density of the voltage impressed between the sacrificial anode and the structure is increased. Correspondingly, decreasing the amount of chain immersed in the brine decreases the current density of the voltage impressed between the structure and the chain. In this fashion, an appropriate polarization level is maintained. That is, the normal corrosion phenomena acting upon the structure is inhibited, while a minimal errosion rate of the sacrificial anode is maintained.

BRIEF DESCRIPTION OF THE DRAWINGS

In the drawings, which illustrate the best mode presently contemplated for carrying out the invention.

DESCRIPTION OF THE ILLUSTRATED EMBODIMENT

Figure 6:
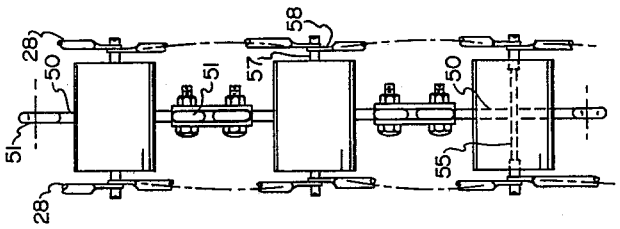
FIG. 6 shows a similar chain of anodes of an alternative form oriented as in FIG. 5.

As illustrated, a drilling platform structure 21 is located off shore with support members 22 immersed in sea water 23. These members are typically of ferrous metal usually steel, and are subject to corrosion. A working station 24 is supported by the members 22. It is accepted within the industry that corrosion of structure in contact with sea water can be substantially reduced, often entirely eliminated, by reducing the potential of the structure (causing it to become more negative) with respect to the potential of a silver-silver chloride half cell to levels up to about −1,050 millivolts. Lower (more negative) surface potentials tend to be destructive of surface coatings such as paints. The surface potential (polarization level) desired in a particular instance may depend upon the precise material of construction of the structure 21, the nature of the brine 23 and other factors generally recognized by those skilled in the art. No matter what polarization level is desired in a specific case, the principles of this disclosure are generally applicable.

According to this invention, the desired, preselected surface potential is achieved by suspending a chain 25 of individual sacrificial marine anodes 26 in the brine 23. The chain 25 is conductively connected to the structure 21, e.g., by a cable (or cables) 28 which is also conductively connected to each anode 26. Accordingly, a circuit is established between the structure 21, the cable 28, the anodes 26, through the sea water 23 and back to the structure 21. Thus, electrons tend to migrate from the anodes 26 to the structural members 22 at a current density determined by the surface potential of the sacrificial anode 26 and the length of the segment 30 of the chain 25 immersed in the brine 23.

The polarization level of the structure may be monitored by means of a conventional polarization meter 35 connected between the structure 21 and a reference silver-silver chloride half cell (reference electrode) 36 suspended in the brine 23. When it is necessary to increase the current density in the aforedescribed circuit, additional links of the chain 25 may be let down to increase the segment 30 immersed in the sea brine 23. A reduction in current density is effected by drawing up links of the chain 25 to reduce the length of the segment 30. It is apparant that this procedure could be automated in response to the detection of the meter 35 or a similar device. Such sophistication is ordinarily dispensed with, however, because in practice infrequent adjustments of the length of segment 30 are all that is required for adequate protection of the structure 21.

Figure 2:
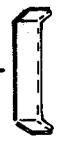
FIG. 2 is a plan view of a portion of the apparatus of FIG. 1.
Figure 2:
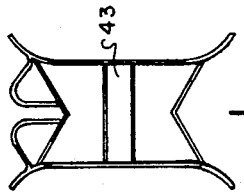
Figure 3:
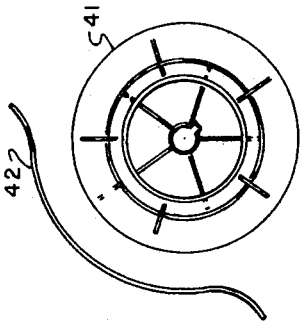
FIG. 3 is a view in section of the apparatus of FIG. 2 taken along the reference line 3—3 of FIG. 2.
Figure 1:
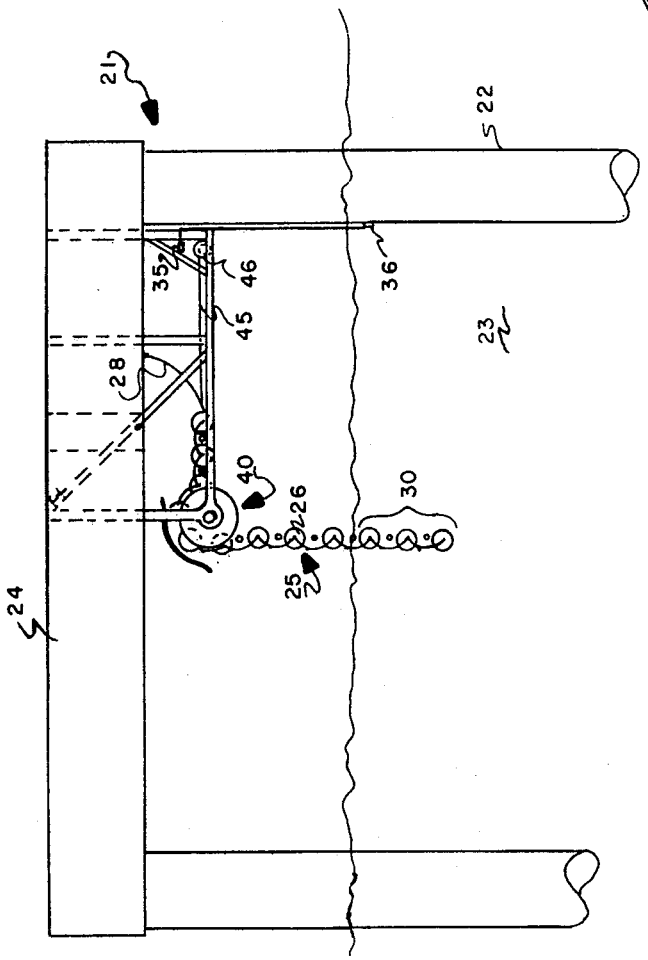
FIG. 1 is a partial view in side elevation of a typical installation incorporating the invention.

Adjustment of the segment length 30 is effected through a windlass arrangement 40 including a reel 41 (FIG. 3) and guard plate 42. The reel 41 illustrated includes a cable slot 43 (FIG. 2) to accommodate a steel cable 45 which extends from the top of the chain 25 to a cable windlass 46.

Figure 5:
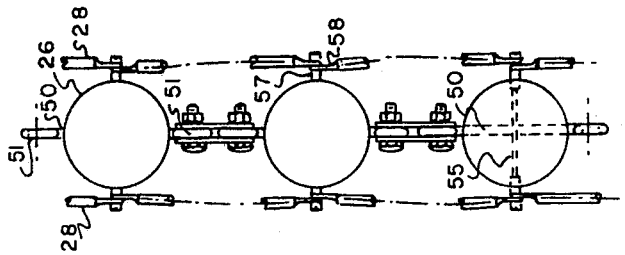
FIG. 5 shows the anode chain of FIG. 4 rotated 90°.
Figure 4:
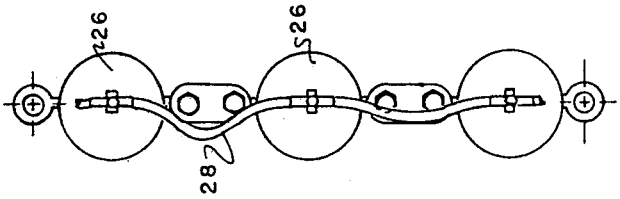
FIG. 4 shows a typical anode chain of this invention.

The chain itself (FIGS. 4 and 5) is made up of individual links each of which comprises a spherical anode 26 of sacrificial marine anode material (e.g. selected from the group consisting of marine grade magnesium and marine alloys of aluminum) formed around a steel structural core 50 with eyes (rings) 51 at each end. The eyes 51 of adjacent cores 50 are shackled together with flat plates 52 and bolts, as shown, to fashion an articulated joint. The conductors 28 are segmented and connect with activator cores of the type and composition described in the aforesaid U.S. patent application Ser. Nos. 707,675 and 719,990, the disclosures of which are incorporated herein by reference. It should be understood that the individual anodes may be configurated as desired, e.g., cylinders (FIG. 6), but that spherical anodes, such as those illustrated, are generally preferred. Moreover, activator cores, while highly preferred, are not essential.

A typical anode of KA-46 marine aluminum alloy will contain about 263 pounds of anode alloy cast in the form of an approximately 17 inches diameter sphere. The structural core 50 may be of forged steel about 22–23 inches long, measured center-to-center between the eyes 51. The conductors 28 may be 4/0 copper cable connected to the activator core 55. This core 55 may be formed of a pair of ⅜ inch diameter copper rods about 16 inches long brazed to end blocks 57 anchored (for example, by being cast in place) to the anode metal and adapted to receive cable lugs 58.

An alternative anode is comprised of about 263 pounds of AZ-63 magnesium alloy cast in a sphere approximately 20 inches in diameter. The structural core would then be about 25–26 inches long, measured center-to-center between eyes 51. The copper activator rods would be about 19 inches long. Generally, the structures of the spherical anodes of this invention are similar, but the winch reel 41, cable 28 lengths, etc. must, of course, be sized to be compatible with the anodes selected for use.

The activator material for the core 55 may be selected in accordance with the teachings of the aforesaid parent applications. Ideally, the marine anode material should have a potential measured with respect to a silver-silver chloride half cell more negative than about −1,000 millivolts, and the activator material should be at least about 600 millivolts positive with respect to the surface potential of the anode material.

Reference herein to details of the illustrated embodiments should not be taken as limiting the scope of the appended claims which themselves recite those details regarded as essential to the invention.

I claim:

1. A cathodic protection system for metallic structures disposed in contact with brine, comprising:

a plurality of sacrificial marine anodes mechanically linked in a chain;

conductive means for electrically coupling said chain of anodes to said structure;

support for suspending said chain above said brine with a portion including one end of said chain immersed therein; and means above said brine and operably associated with the end of said chain opposite said one end for selectively paying out and retrieving said chain to correspondingly increase or decrease the amount of said chain, including said one end, immersed in said brine, thereby to correspondingly increase or decrease the current density impressed between the anodes and the structure through said brine.

2. A system in accordance with claim 1 wherein said conductive means is an electric cable, and each anode in said chain is electrically coupled directly to said cable.

3. A system in accordance with claim 1 wherein the individual anodes of the chain comprise a mass of marine anode metal having a surface potential more negative than about −1,000 millivolts with respect to a silver-silver chloride half cell.

4. A system according to claim 3 wherein said anode metal is selected from the group consisting of marine grade magnesium and marine alloys of aluminum.

5. A system according to claim 4 wherein said anode metal is AZ-63 magnesium.

6. A system according to claim 4 wherein said anode metal is KA-46 marine aluminum alloy.

7. A system according to claim 1 wherein each individual anode of said chain is cast about a middle portion of a linkage member so that end portions of said linkage member extend from said anode, and said ends are adapted to interconnect with other structure on said chain to form an articulate joint.

8. A system according to claim 7 wherein the linkage members of adjacent anodes are connected in a shackle assembly.

9. A system according to claim 8 wherein the linkage members and shackle assembly are of steel, and the anode is of either marine grade aluminum alloy or marine grade magnesium.

10. A system according to claim 1 wherein each individual anode is directly coupled to an activator having a surface potential of at least 600 millivolts less negative than the normal surface potential of the anode material.

11. A system according to claim 1 wherein each anode is cast with a core of activator material and the anode material and activator material are selected such that the anode material has a surface potential measured with respect to a silver-silver chloride half cell more negative than about −1,000 millivolts and the activator material has a corresponding surface potential at least about 600 millivolts positive with respect to the surface potential of said anode material, a portion of said core projecting from said anode.

12. A system according to claim 11 wherein the core of each anode in said chain is directly coupled to a common conductor which is electrically coupled to said structure.

13. A system according to claim 12 wherein the activating material of said cores comprises copper.

14. A system according to claim 13 wherein the anodes comprise magnesium metal.

15. The system according to claim 14 wherein the anodes comprise AZ-63 magnesium.

16. A system according to claim 13 wherein the anodes comprise marine aluminum alloy metal.

17. A system according to claim 16 wherein the anodes comprise KA-46 aluminum alloy or its equivalent.

18. A system according to claim 13 wherein each of the anodes is circular in cross-section taken transverse said core.

19. A system according to claim 18 wherein said anodes are approximately spherical in shape.

20. A system according to claim 18 wherein said anodes are approximately cylindrical in shape.

21. A cathodic protection system for a ferrous metal structure disposed in sea water, comprising:

a plurality of sacrificial marine anodes mechanically linked in a chain, wherein said chain is suspended from said structure to hang with a portion including one end immersed in said sea water, and each anode in the chain is conductively connected to said structure; further comprising:

means above said sea water and operably associated with said chain for lengthening or shortening the portion of the chain immersed in the sea water, thereby correspondingly increasing or decreasing, respectively, the current density impressed between said anodes and the structure through said sea water.

22. A cathodic system according to claim 21 wherein said means for shortening or lengthening the immersed portion of the chain comprises a winch apparatus arranged selectively to let out or retrieve said chain.

23. A system according to claim 22 wherein the chain is comprised of links, each of which includes an anode, associated linking structure interconnecting with corresponding structure carried by adjacent links, and means for directly coupling the anode to cable means conductively connected to said structure.

* * * * *